US007634881B2

(12) United States Patent
Ahren et al.

(10) Patent No.: US 7,634,881 B2
(45) Date of Patent: Dec. 22, 2009

(54) CROSS PANEL

(75) Inventors: Gregory M. Ahren, Lakewood, OH (US); John D. Bankston, Amherst, OH (US)

(73) Assignee: USG Interiors, Inc., Chicago, IL (US)

( * ) Notice: Subject to any disclaimer, the term of this patent is extended or adjusted under 35 U.S.C. 154(b) by 399 days.

(21) Appl. No.: 11/263,406

(22) Filed: Oct. 31, 2005

(65) Prior Publication Data

US 2007/0107353 A1 May 17, 2007

(51) Int. Cl.
*E04B 9/00* (2006.01)

(52) U.S. Cl. ..... 52/506.06; 52/506.1; 52/506.08; 52/762

(58) Field of Classification Search ..... 52/39, 52/506.1, 506.07, 506.8, 762, 780, 781, 775, 52/506.03, 506.06
See application file for complete search history.

(56) References Cited

U.S. PATENT DOCUMENTS 2,099,211 A * 11/1937 Lucius ..... 52/781
2,112,631 A * 3/1938 MacDonald ..... 52/144
3,193,063 A * 7/1965 Brown et al. ..... 52/667
3,706,171 A * 12/1972 Shayman ..... 52/506.08
4,760,677 A * 8/1988 Nassof ..... 52/506.1
4,773,200 A * 9/1988 Young ..... 52/506.06
4,866,900 A * 9/1989 Dunn ..... 52/506.07
4,912,894 A * 4/1990 Platt ..... 52/98
5,311,719 A * 5/1994 Jahn ..... 52/506.09
5,363,622 A * 11/1994 Sauer ..... 52/506.07
5,761,868 A * 6/1998 LaLonde et al. ..... 52/506.07
2002/0083669 A1* 7/2002 Paul ..... 52/506.06

FOREIGN PATENT DOCUMENTS

GB 2 273 511 A 6/1994
GB 2273511 A * 6/1994

* cited by examiner

*Primary Examiner*—Basil Katcheves
(74) *Attorney, Agent, or Firm*—Pearne & Gordon LLP

(57) ABSTRACT

A cross panel for a grid type suspended ceiling comprising a sheet metal body forming a rectangular face adapted to close the space between the flanges of a pair of parallel grid tees. The panel has four connectors each adjacent a respective corner of the panel face and adapted to extend through a slot in the web of the adjacent grid tee for interlocking the panel to the tees in a manner that maintains the parallel spacing and alignment of the tees and affords a simple, aesthetically pleasing appearance.

8 Claims, 3 Drawing Sheets

FIG. 4
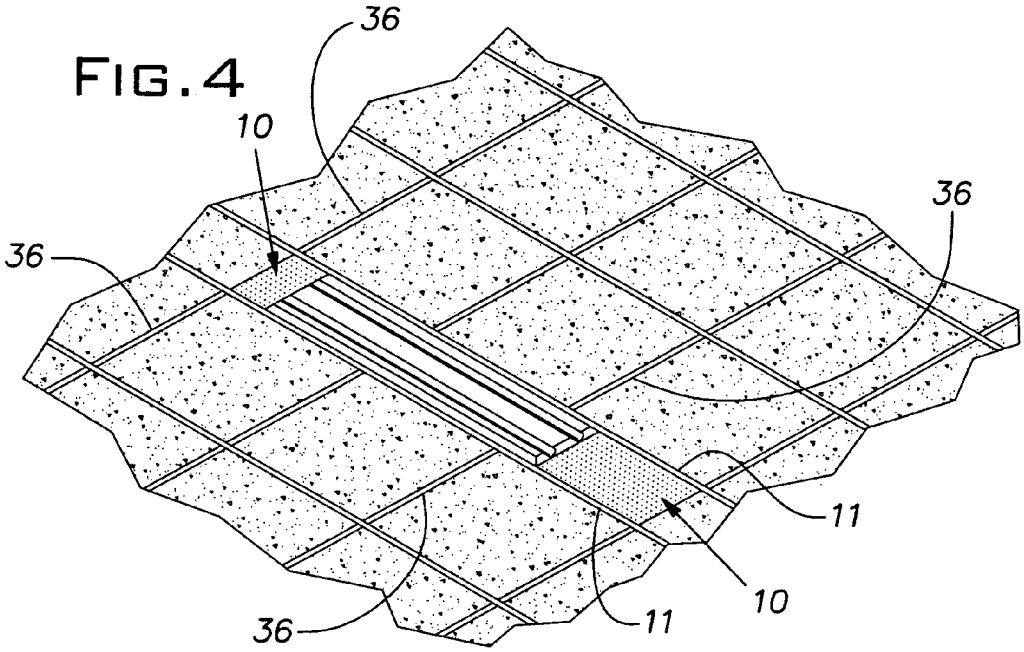
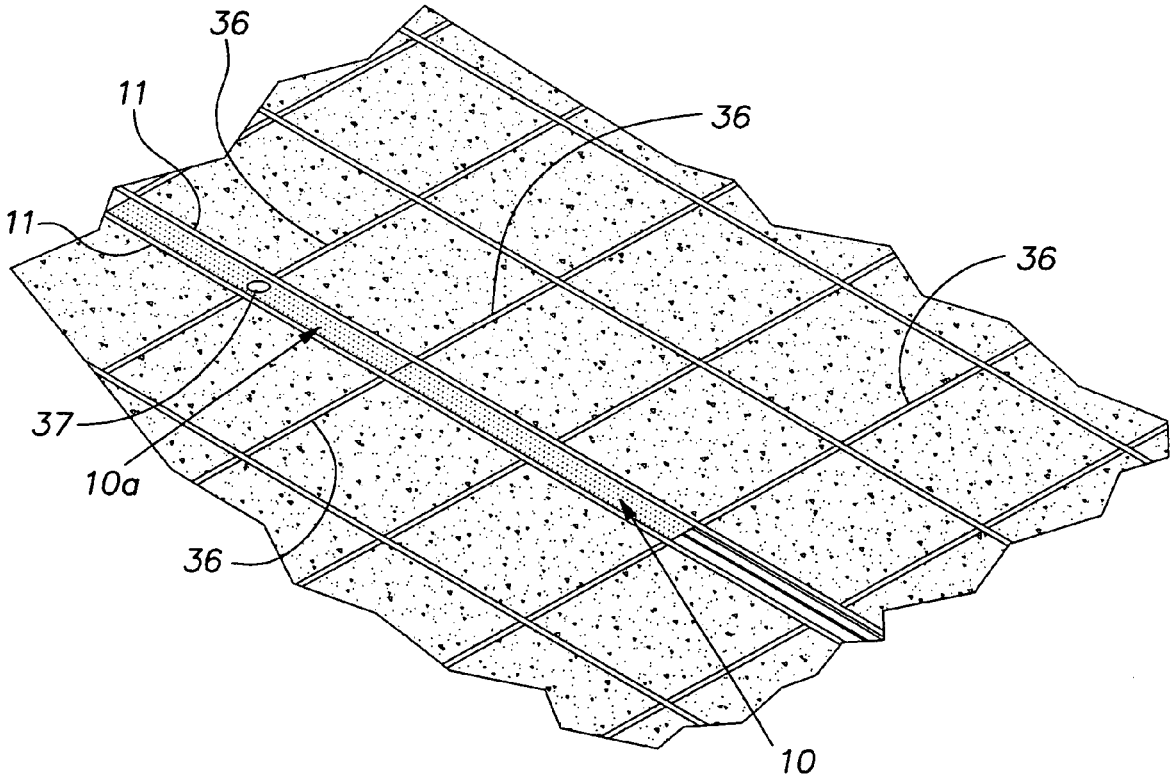
FIG. 5

CROSS PANEL

BACKGROUND OF THE INVENTION

The invention relates to suspended ceiling systems and, in particular, to specialized panels for such systems.

PRIOR ART

In contemporary commercial buildings, grid type suspended ceilings are widely, if not almost universally, used. In most suspended ceilings, the ceiling grid pattern is interrupted by light fixtures and, often, conditioning air vents, sprinkler heads, speakers, utility conduits, exit signs, and so forth. Architects strive to integrate these necessary service related elements into the grid to achieve a simple and, therefore, more aesthetically pleasing appearance.

Frequently, elongated light fixtures and/or air vents are longitudinally aligned and spaced along a line that interrupts the regular rectangular grid pattern, ordinarily being parallel to one or the other directions of the grid. Where these fixtures are of a size, typically a width, different from a standard grid module dimension, it has been a practice to custom make cross tee grid members of a nominal length equal to the nominal width of the fixture. That is, the spacing of the main runners or tees conforms to or straddles the fixture and, in turn, the custom made cross tees conform to the desired spacing of the main runners or tees. This customization of the cross tees can be expensive, if not prohibitively expensive. Even when customized cross tees can be economically justified, there remains the problem of fashioning a ceiling tile or panel to an appropriate custom size. With traditional grid and panel systems, it can be difficult for a single trade to complete a ceiling grid installation without interruption due to the overlapping of tasks of different trades. For example, the ceiling installation can involve issues of the division of labor between carpenters and sheet metal workers, for example.

SUMMARY OF THE INVENTION

The invention involves a ceiling panel that constitutes a visible part of the ceiling surface and that also provides the structural function of a cross tie between main runners or tees. In the disclosed arrangements, the panel is a rectangular sheet metal unit that has connectors at each of its four corners for engaging the webs of a pair of parallel main tees. The connectors may be formed integrally with the sheet metal of the panel or may be separately formed and fixed to the panel. The connectors are preferably blade-like in configuration so that they can be inserted into the conventional connector receiving slots in the webs of the parallel main tees. The panel connectors in cooperation with the panel itself are arranged to hold the main tees in parallel alignment, preferably against both compressive and tensile forces.

The panel can be arranged to work with and/or without the module dimensions of the grid. Besides affording a broad range of rectangular shapes and sizes, the panel can be arranged with a variety of surface treatments including textures, contours extending above and/or below the plane of the surrounding grid, and small and large perforations of any desired pattern or spacing. Among other advantages, the panel can have punching for sprinkler heads, can conceal public address speakers, and can act as a return air grille for HVAC systems, thus further organizing the ceiling plane in an aesthetic way while providing these utilities or functions.

BRIEF DESCRIPTION OF THE DRAWINGS

FIG. 4 is a somewhat schematic fragmentary perspective view from below of a suspended ceiling system showing the relationship of cross panels and a surrounding grid; and FIG. 5 is a somewhat schematic fragmentary perspective view of a suspended ceiling system showing cross panels of configurations different than those of FIG. 4.

DESCRIPTION OF THE PREFERRED EMBODIMENTS

Figure 1:
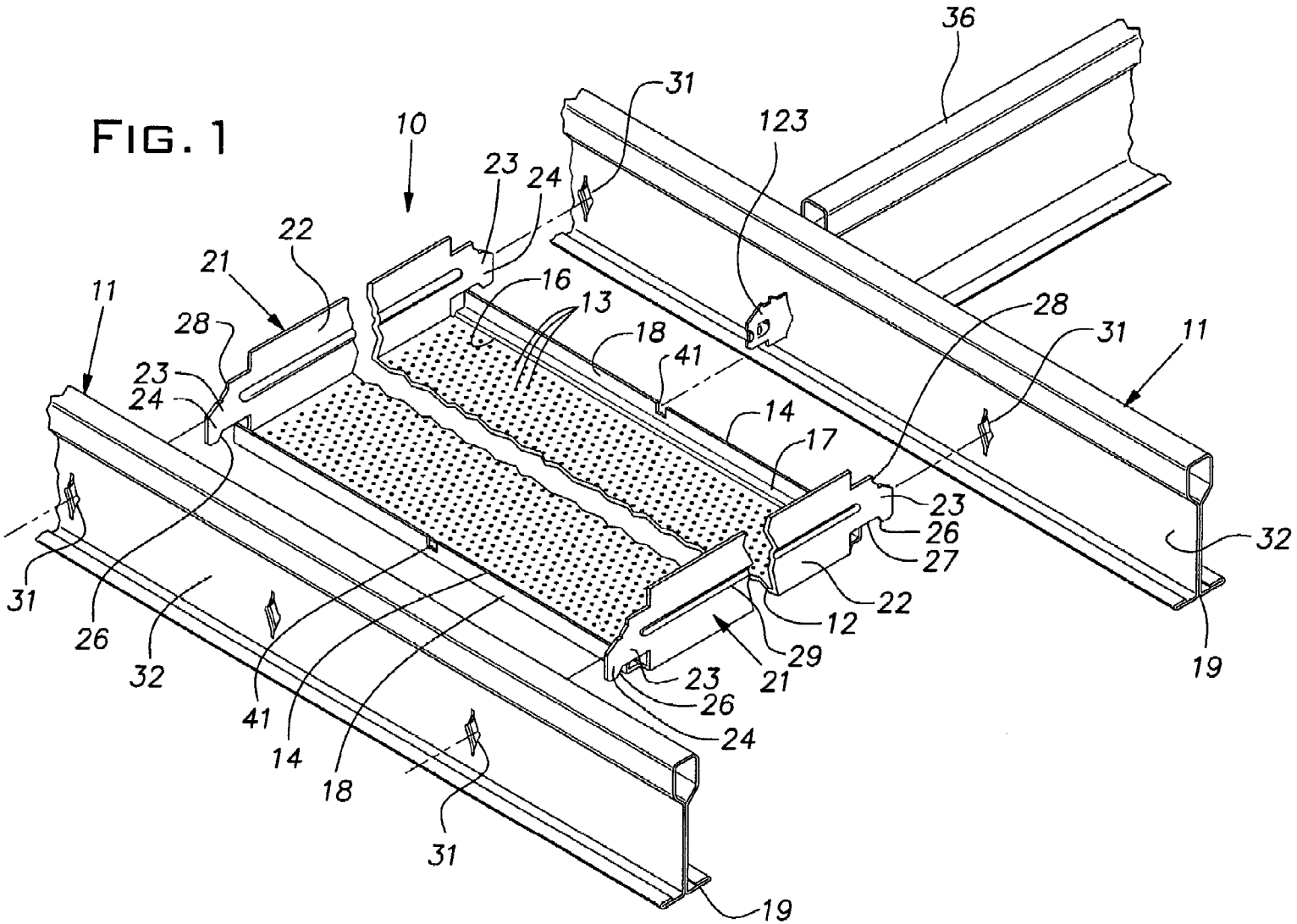
FIG. 1 is an exploded perspective fragmentary view of a ceiling system employing a cross panel constructed in accordance with the invention.

FIG. 1 shows a ceiling cross panel 10 in a fragmentary exploded perspective assembly view with a pair of parallel main tees 11. The illustrated cross panel 10 is formed of a single sheet of light gauge sheet metal such as aluminum or mild steel. In the illustrated example, the cross panel has a face 12 visible from below the ceiling and having a rectangular periphery. The face, in the illustrated case, is perforated with a multitude of small regularly spaced holes throughout substantially its full area. The holes or perforations 13 can serve to pass sound and/or permit air circulation through the cross panel 10. The panel face 12, at least, can be painted or otherwise finished as desired.

Figure 2:
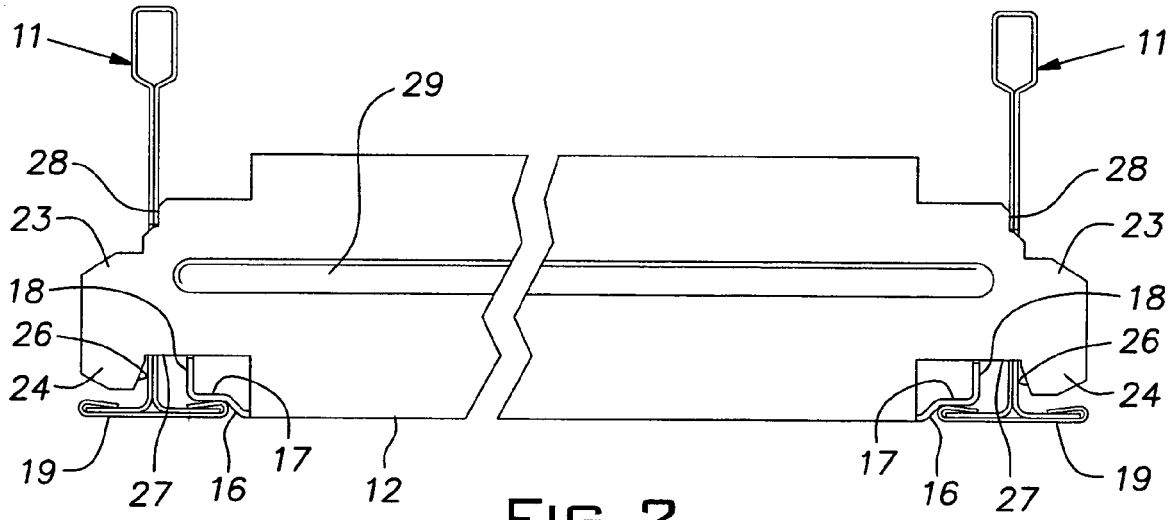
FIG. 2 is an elevational view of the cross end of a cross panel.
Figure 3:
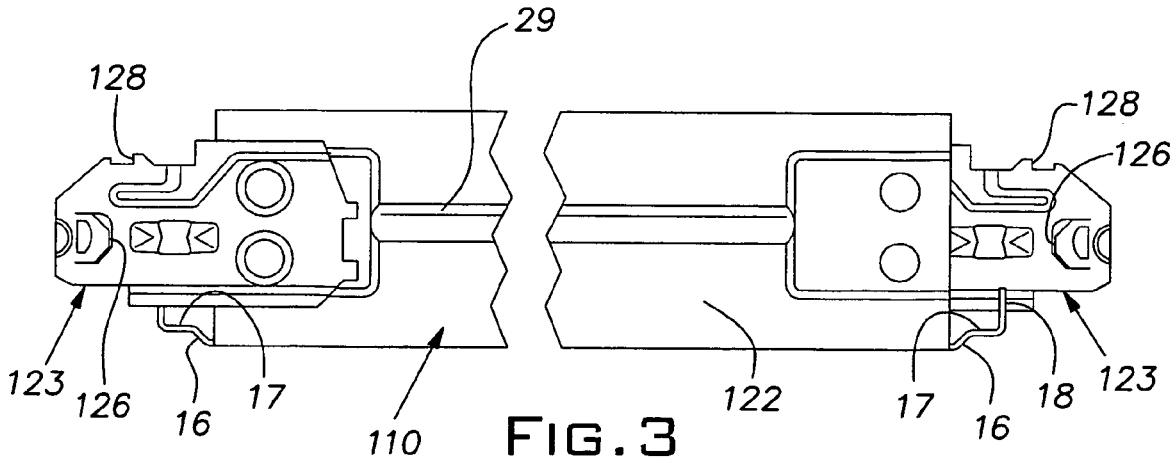
FIG. 3 is a view similar to FIG. 2 showing a second embodiment of a cross panel.

Opposed edges 14 of the cross panel, sometimes referred to hereinafter as longitudinal edges, are parallel with the longitudinal direction of the main tees 11. The longitudinal edges 14 each have an associated small upward step 16 (FIG. 2), a relatively narrow horizontal shelf 17, and a vertical flange 18. In the illustrated case, the step 16, shelf 17 and flange 18 extend substantially along the full longitudinal extent of the edges 14. The resulting vertical offset of the shelf 17 above the face 12 allows the face to sit flush with faces 19 of the main tees 11 and, ordinarily, faces of the remainder of the grid system as shown in FIGS. 2 and 3. While the illustrated tee 11 is of a narrow design, the cross panel step 16 and shelf 17 can be configured for use with tees of other widths. Alternatively, the step 16 can be omitted and the cross panel can be simply formed as a "lay-on" panel. The vertical flange 18 extending perpendicularly to the plane of the panel face 12 serves to stiffen the cross panel 10.

Opposed edges 21 of the cross panel 10, sometimes referred to hereinafter as cross edges or cross sides, each have an associated vertical or upstanding flange 22 extending along the full cross length of the cross panel 10. Adjacent each corner of the rectangular panel face 12, is a connector 23 extending, in the manner of a cantilever, from a respective end of a cross flange 22 laterally beyond the panel face 12 and beyond the adjacent stiffening flange 18. The connectors 23, preferably, are identical and each is blade-like with a vertical extent substantially greater than its thickness or horizontal extent. The connector 23 at its distal end has a depending hook configuration 24 with an abutment edge surface 26 that faces generally laterally inwardly towards the main part of the cross panel 10, i.e. the cross panel proper. A clearance notch 27 exists between the hook edge surface 26 and the adjacent part of the associated end of the flange 22. Above and slightly laterally inwardly of the hook or catch surface 26 is an outwardly facing abutment edge surface 28. A crease 29 forming an inward rib running lengthwise of the flange 22 and partially along the connectors 23 serves to stiffen these elements.

FIG. 2 illustrates the cross panel 10 in an installed condition between a pair of parallel grid members or main tees 11. Normally, the grid members will be so called main runners or main tees with lengths typically greater than a module dimension. For example, the tees can have lengths of 10 or 12 feet while a module of a ceiling grid may be typically two, four or five feet. Each connector 23 is inserted through a receiving slot 31 formed in a web 32 of a respective main tee 11. This insertion is accomplished by raising the connector 23 so that the hook 24 passes over the lower edge of the slot 31 while the top of the tee 11 is tilted away from the panel 10 and the hook is allowed to drop down to catch the web 32 on its side opposite the panels. The cross panel 10 ordinarily with identical cross panels or cross panels of the same cross-wise dimension, is sized to establish and maintain a desired uniform parallel spacing between the main tees 11. Inspection of FIG. 2 shows that forces tending to separate the main tees 11 are resisted by the hook edge surfaces 26 and forces tending to move the tees towards one another, i.e., in convergence, are resisted by the abutment surfaces 28.

From this explanation, it will be understood that the cross panel serves both as a visible appearance panel in a ceiling distinguishable from the narrow strip of a grid tee, and as a cross tie member with the function of a traditional grid cross tee. The cross panel can additionally align and/or retain the parallel main tees in end-to-end or longitudinal alignment and can assist in maintaining the grid square such that the tees intersect at right angles.

Typically, but not necessarily, the slots 31 for the connectors 23 on the tees 11 are on standardized centers, e.g. every six inches. Where a panel 10 is longer than this center-to-center distance and there is a cross tee connector 123 in an intermediate slot or slots 31, the panel flange 18 can be formed with a notch or clearance hole or holes 41 for clearance of the connector(s).

The cross panel 10 can be configured in various cross-width-to-length ratios. The width established between main tees 11 by the flanges 22 and connectors 23 can be less than (as shown in FIG. 2) equal to, or greater than the other dimension of the cross panel, i.e. the distance between the cross flanges 22.

FIGS. 4 and 5 illustrate typical variations in the size and configuration of a cross panel 10. In FIG. 4, the cross panels 10 are of different dimension along the length of the main tees 11. As also shown in FIG. 4, the cross panel 10 can be arranged with its cross edges or ends, as represented by the vertical flanges 22, located on or off the grid module centers of cross tees 36. FIG. 5 illustrates a condition where the cross panels 10 are greater in length than a grid module between cross tees 36. One cross panel 10*a* is modified, by way of example, by incorporating a hole 37, sized to accommodate a sprinkler head. As a general rule, a cross panel 10 will have a rectangular profile in plan view, a square cross panel being considered a species of a rectangular cross panel. It will be appreciated that the face 12 of a cross panel may be non-planar, projecting above and/or below the plane of the main part of a ceiling structure. Additionally, the cross panel face 12 can be imperforate or perforate, and finished as desired.

Referring to FIG. 3, a modified cross panel 110 is disclosed. The cross panel 110 can have the same general geometry as the cross-panel 10 described with reference to FIGS. 1 and 2 with the exception that the connector 123 on each corner of the cross panel 110 is a separate part fixed to the sheet metal forming the cross panel 110 proper. The connector 123 can be of the type disclosed in U.S. Pat. No. 5,761,868, the disclosure of which is included herein by reference, or any other similar clip that is normally assembled to ceiling grid cross tees as is known in the industry. The connector 123 is permanently clinched or otherwise fixed on the end of a respective cross flange 122 in a known manner. The connector 123 can be coupled with an identical connector assembled through a common slot 31 or hole in the web 32 of a main tee 11 from the side of the main tee opposite the side at which the cross panel 110 is situated. Each connector 123 is capable of resisting forces tending to either spread or converge the main tees 11 to which they are connected whether or not coupled to an opposed connector at their respective main tee slots 31. A rearwardly facing edge surface 126 resists separation and a forwardly facing edge surface 128 resists convergence between the main tees 11.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A cross panel for use in a grid-type suspended ceiling, the panel being made of sheet metal and having a main face extending across a rectangular area bounded by first and second pairs of opposite sides, a pair of vertical flanges extending lengthwise along the first pair of opposite sides of said area, each flange having an end adjacent each of said second pair of opposite sides, the length of said flanges between their respective ends being sufficient to substantially span the distance between the second pair of opposite sides of said area, and a connector on each flange end that projects in cantilever fashion horizontally from the flange in a direction along the longitudinal direction of the flange beyond the respective side of said second pair of opposite sides, each connector being generally planar and blade-like in its configuration such that it is free of structure at an upper edge that can overlap an opposing connector and generally vertical in its orientation whereby it is adapted to be inserted into a generally narrow vertically oriented slot in the vertical web of a grid tee, the connector having a rearwardly facing locking surface adapted to grip a side of a grid tee web opposite the side of the web from which it is inserted in the slot, a flange along each of said second pair of opposite sides of said rectangular area that serves to stiffen said panel, said flanges at the first pair of sides being substantially vertical, whereby said cross panel is adapted to form a butt joint with an identical panel at each of said flanges.

2. A cross panel as set forth in claim 1, wherein the locking surface is an edge of the connector.

3. A cross panel as set forth in claim 1, wherein the connector is one-piece with the panel.

4. A cross panel as set forth in claim 1, wherein the sides of the rectangular area with which said flanges extend along are longer than the other sides.

5. A cross panel as set forth in claim 1, wherein the sides of the rectangular area with which said flanges extend along are shorter than the other sides.

6. A cross panel as set forth in claim 1, wherein the connector includes a depending hook which can be installed in a slot from a raised position, and which when inserted in a slot and lowered from said raised position, is adapted to grip the opposed side of the grid tee web adjacent the lower end of the slot.

7. A cross panel for a suspended ceiling of the type using a grid of tees, the panel being formed of a sheet metal body having a rectangular face bounded by four sides intersecting at corners, a vertical blade-like connector adjacent each corner, each connector having a cantilevered portion adapted to be inserted into a relatively narrow vertical slot formed in a web of a tee, the cantilevered portion having a free length beyond its respective corner of the face sufficient to extend through the web and having a catch surface arranged to lock onto the web by engaging a surface area of the web on a side thereof facing away from the panel and prevent relative movement of the tee away from the panel, the connectors each having an abutment surface adapted to engage a surface area of the web adjacent the slot on a side thereof facing said panel and prevent relative movement of said tee towards said panel, the cantilevered portion of the blade-like connector being free of an upper edge that can overlap an opposing connector, said panel including a stiffening formation along each of a pair of the sides, said stiffening formation including an upstanding flange.

8. A cross panel as set forth in claim 7, wherein said upstanding flange along each of the pair of the sides includes a cutout for clearance of a connector on a cross tee inserted through a grid tee at a slot between the slots in which a pair of said panel connectors are assembled and from a side of the grid tee opposite the side on which said cross panel is assembled.

* * * * *

UNITED STATES PATENT AND TRADEMARK OFFICE

CERTIFICATE OF CORRECTION

PATENT NO. : 7,634,881 B2
APPLICATION NO. : 11/263406
DATED : December 22, 2009
INVENTOR(S) : Ahren et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this

Ninth Day of November, 2010

David J. Kappos

David J. Kappos
*Director of the United States Patent and Trademark Office*